US005174573A

United States Patent [19]

Desbiolles et al.

[11] Patent Number: 5,174,573

[45] Date of Patent: Dec. 29, 1992

[54] PUTTER HAVING A HEAD WITH BALL-CENTERING INDICIA

[75] Inventors: Jacques Desbiolles, Annecy; Andre Pernelle, Seynod, both of France

[73] Assignee: Taylor Made Golf Co., Inc., Carlsbad, Calif.

[21] Appl. No.: 531,105

[22] Filed: May 31, 1990

[30] Foreign Application Priority Data

Jun. 1, 1989 [FR] France ..... 89 07247

[51] Int. Cl.[5] ..... A63B 53/04

[52] U.S. Cl. ..... 273/164.2; 273/167 R; 273/187.4

[58] Field of Search ..... 273/77 R, 162 R, 162 B, 273/164, 167 R, 167 A, 167 B, 167 C, 167 D, 167 E, 167 F, 167 J, 167 K, 183 C, 183 D, 186 R, 186 A

[56] References Cited

U.S. PATENT DOCUMENTS

| | | | |
|---|---|---|---|
| 3,333,854 | 8/1967 | White | 273/164 A |
| 3,708,172 | 1/1973 | Rango | 273/164 A |
| 3,829,102 | 8/1974 | Harrison | 273/186 A |
| 4,136,877 | 1/1979 | Antonious | 273/183 D X |
| 4,508,350 | 4/1985 | Duclos | 273/183 D |
| 4,809,981 | 3/1989 | Doran et al. | 273/164 A |
| 4,915,385 | 4/1990 | Anderson | 273/164 A |

*Primary Examiner*—V. Millin
*Assistant Examiner*—William M. Pierce
*Attorney, Agent, or Firm*—Sandler, Greenblum & Bernstein

[57] ABSTRACT

A putter having a head with golf ball-centering indicia. The ball-centering indicia include a curvilinear reference which is tangent to the edge formed between the upper surface of the head and the ball-striking surface, or to a parallel line proximate the edge. The curvilinear reference has a radius of curvature which the substantially equal to the nominal radius of a golf ball and is subtended, with reference to the center of curvature by a center angle less than 180° and preferably about 90°. The ball-centering indicia further include a rectilinear reference formed, for example, by a pair of parallel segments positioned symmetrically on both sides of the normal to the tangent point, extending along the direction of the aiming axis. A parallax correction reference can also be provided which enables the golfer to ensure that the head of the putter is properly horizontally positioned about the aiming axis.

20 Claims, 3 Drawing Sheets

FIG_2
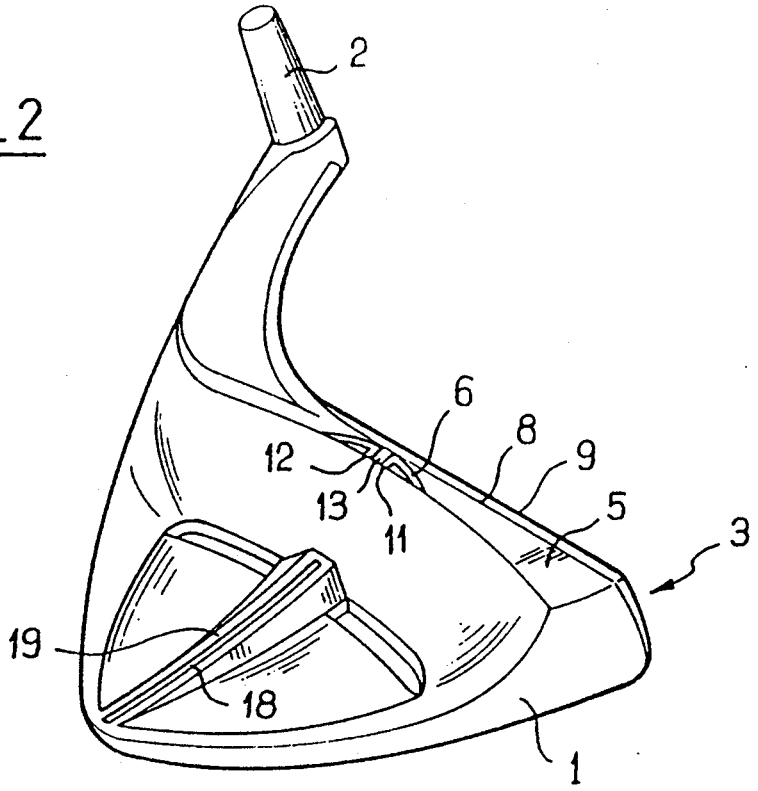
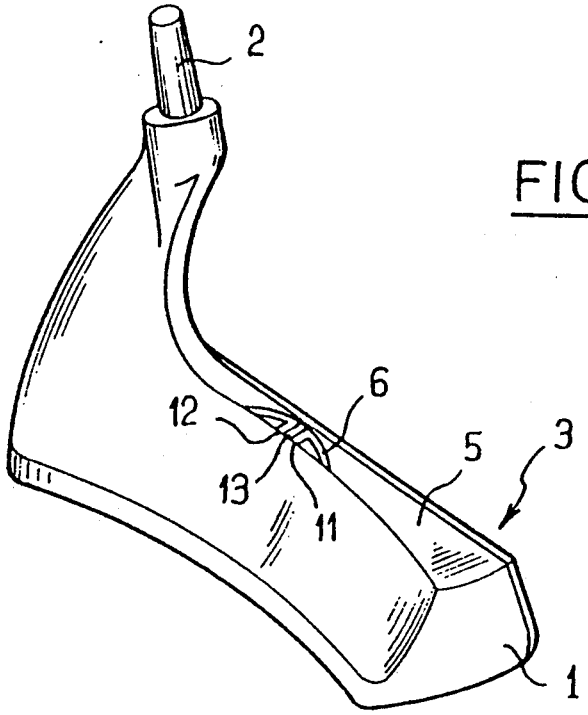
FIG_3

PUTTER HAVING A HEAD WITH BALL-CENTERING INDICIA

BACKGROUND OF THE INVENTION

1. Field of the Invention

The present invention relates to a putter, i.e., a particular golf club designed for striking a golf ball toward a hole, particularly after the golfer has played the ball to the green, and is a relatively short distance from the hole.

2. Description of Background and Other Information

The head of such a putter includes a vertical hitting surface and an upper surface which is known to include reference indicia for centering the ball. Such reference indicia on the head can take the form of a symmetrical design with respect to an aiming axis, perpendicular to the hitting surface, directed both towards the center of the ball to be hit and towards the hole where the ball is intended to go.

Numerous reference indicia for centering of the ball have been proposed, the most popular including the provision of a circular diagram having the same diameter as the ball which is disclosed, for example, in U.S. Pat. Nos. 3,884,477 and 3,333,854; a spherical shape, likewise having a diameter like that of the ball, as disclosed, for example, in British Patent No. 181,185 and U.S. Pat. No. 4,688,798; or a cylindrical shape of the same diameter as the ball as disclosed, for example, in U.S. Pat. No. 3,708,172.

However, in all of these configurations in which a diagram is provided on the club or a raised portion of the club is provided which is similar to the ball, the eye of the golfer is naturally attracted towards the center of the representation instead of towards the point of impact, i.e., towards the location where the player will hit the ball with the head of the putter.

SUMMARY OF THE INVENTION

It is therefore an object of the present invention to provide a putter which overcomes the disadvantage noted above and which provides a more advantageous ball-centering indicia. To this end, the putter of the present invention includes:

a golf ball-striking surface generally perpendicular to an aiming axis for the putter;

(b) an upper surface intersecting with the striking surface along an edge; and (c) golf ball-centering indicia which include a curvilinear reference having a center of curvature on the aiming axis and extending rearwardly in a direction away from the aiming axis to subtend an angle centered upon the aiming axis.

More specifically according to the present invention, a putter head is provided which has a generally vertical striking surface, which is generally perpendicular to the aiming axis, which forms an edge with the upper surface of the head. The ball-centering indicia is located on the upper surface of the club head and is tangent to the edge, or tangent to a line parallel to the edge, at a point along the aiming axis. The curvilinear line has a radius of curvature at the tangent point which is equal to a nominal radius of curvature of a golf ball and which is subtended with respect to the center of curvature of the radius of curvature by a centering angle which is less than 180°. The ball-centering indicia further include a rectilinear reference extending in the direction of the aiming axis from an area proximate the tangent point.

Preferably according to the invention, the centering angle is 90° or approximately 90°.

Further according to the invention, the rectilinear reference includes, in an area adjacent the tangent point, a pair of parallel marks or segments positioned symmetrically on either side of a line perpendicular to the edge, or perpendicular to the line parallel to the edge.

Still further, each of the segments has a certain width and the parallel segments are spaced apart by an amount equal to or greater than the width. Between the segments, the curvilinear line is discontinuous.

According to a still further aspect of the invention, the curvilinear line has a pair of ends, and the rectilinear reference terminates opposite the tangent point approximately on a chord extending between the ends of the curvilinear line.

According to a still further aspect of the invention, the ball-centering indicia further include a parallax correction reference which extends within a plane along which the rectilinear reference extends, but it is not co-extensive with the rectilinear reference.

More specifically, the parallax correction reference extends rearwardly of the rectilinear reference and below the rectilinear reference.

Further, the ball-centering indicia is symmetrical with respect to a plane containing the aiming axis.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIG. 2 is a perspective view of the putter head according to the invention;

FIG. 3 is a perspective view like that of FIG. 2, but illustrating an alternative embodiment of the putter head according to the invention.

DETAILED DESCRIPTION OF PREFERRED EMBODIMENTS

The present invention has as an objective to provide a putter head which has reference indicia for centering the ball. Although the representation resembles, in part, the shape of the ball to be hit, it does not have the effect of distracting the attention of the golfer from the point of impact.

More specifically, the invention has as an objective to provide a putter head of the type discussed above, i.e., having a vertical hitting surface and an upper surface which forms, at their intersection, a substantially rectilinear edge, the upper surface having ball centering indicia forming a symmetrical diagram with respect to an aiming axis, perpendicular to the hitting surface.

According to the invention, viewed from above, the ball-centering indicia comprise a curvilinear reference, including a curvilinear line generally tangent to the edge or to a parallel straight line proximate the edge. This curvilinear line has, at the point of contact or at a point closest to the point of contact, a radius of curvature which is substantially equal to the nominal radius of the ball to be hit and is subtended, with respect to the center of curvature at the point of contact, through an angle less that 180°, and a rectilinear reference extending along the direction of the aiming axis from the contact point.

According to a certain number of features of the preferred embodiments:

the angle to the center is approximately 90°;

in the area adjacent to the contact point, the rectilinear reference comprises a pair of parallel marks arranged symmetrically on both sides of the normal at the contact point; in such a case, in the transverse direction, the width of the space between the parallel marks is preferably at least equal to the width of each of these marks in this same direction and, adjacent to the contact point, the curvilinear line is not formed on the corresponding space in the space between the parallel marks;

the end of the rectilinear reference opposite to the point of contact is approximately situated on the chord joining the ends of the curvilinear line; and the ball-centering indicia for the ball, furthermore, comprises a parallax correction line, generally extending in the same vertical plane as the rectilinear reference but at a height different therefrom.

Figure 1:
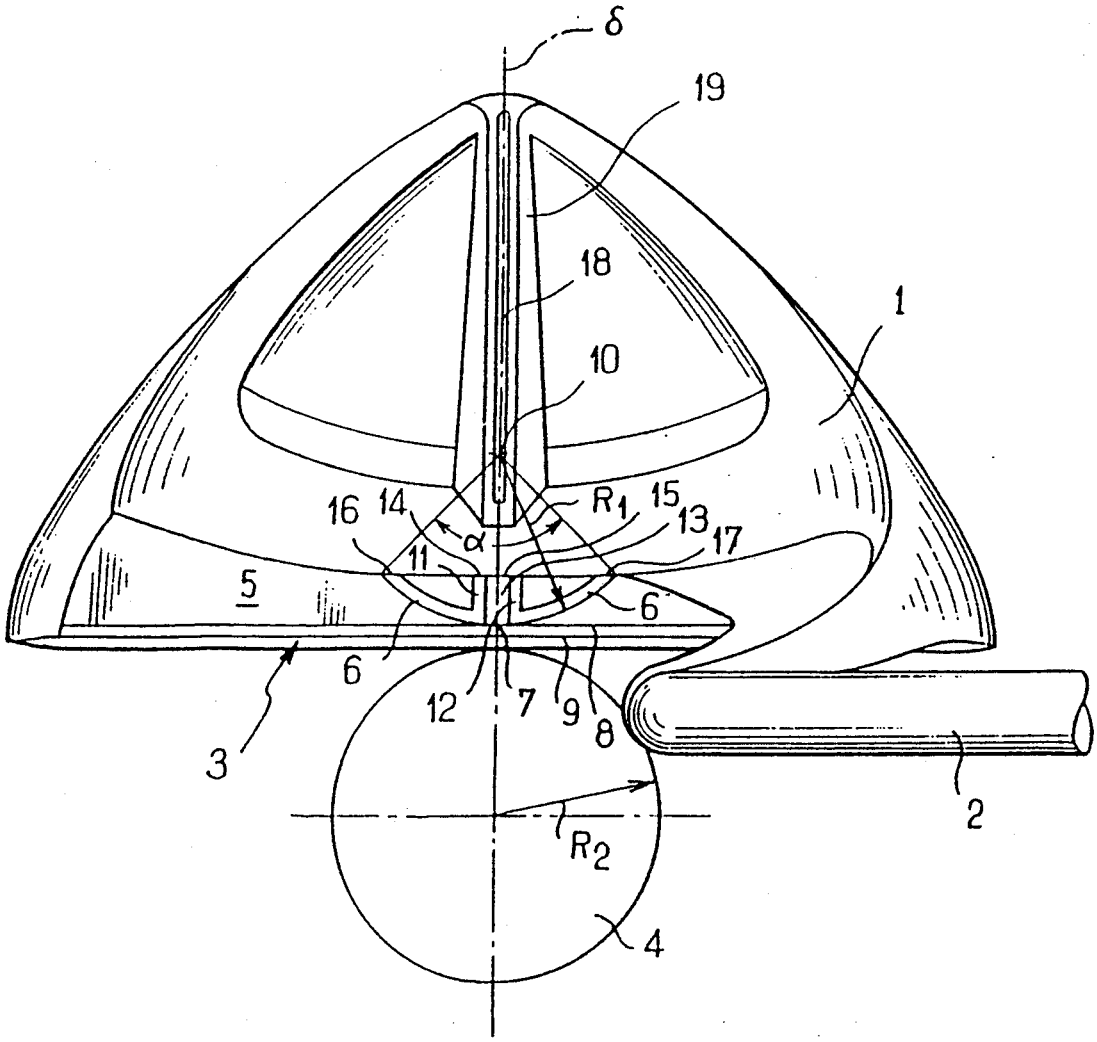
FIGS. 1 is a plan view of the putter head according to the invention.

With reference to FIGS. 1 and 2, it can be seen that the putter head of the invention is essentially constituted by a body 1 which is molded, for example, from a synthetic material or from a metal alloy, appropriately weighted, and connected to a shaft 2.

The front surface of the body, which is the portion of the body that is used to strike the ball, includes a planar surface 3, which is formed as one piece or is assembled from a plurality of elements, and is vertical, or substantially vertical, with reference to the general orientation corresponding to an impact position of the surface 3 with a ball 4. The surface 3 constitutes the hitting surface of the putter which will impact the ball 4.

Body 1 has a general plane of symmetry, identified as δ in FIG. 1, that will be referred to as vertical in the description which follows. In the horizontal plane of FIG. 1, plane δ represents the aiming axis of the putter, i.e., the axis along which, to ensure that the stroke is accurate, one must align both the center of ball 4 and the hole to which the ball is to be directed.

Figure 4:
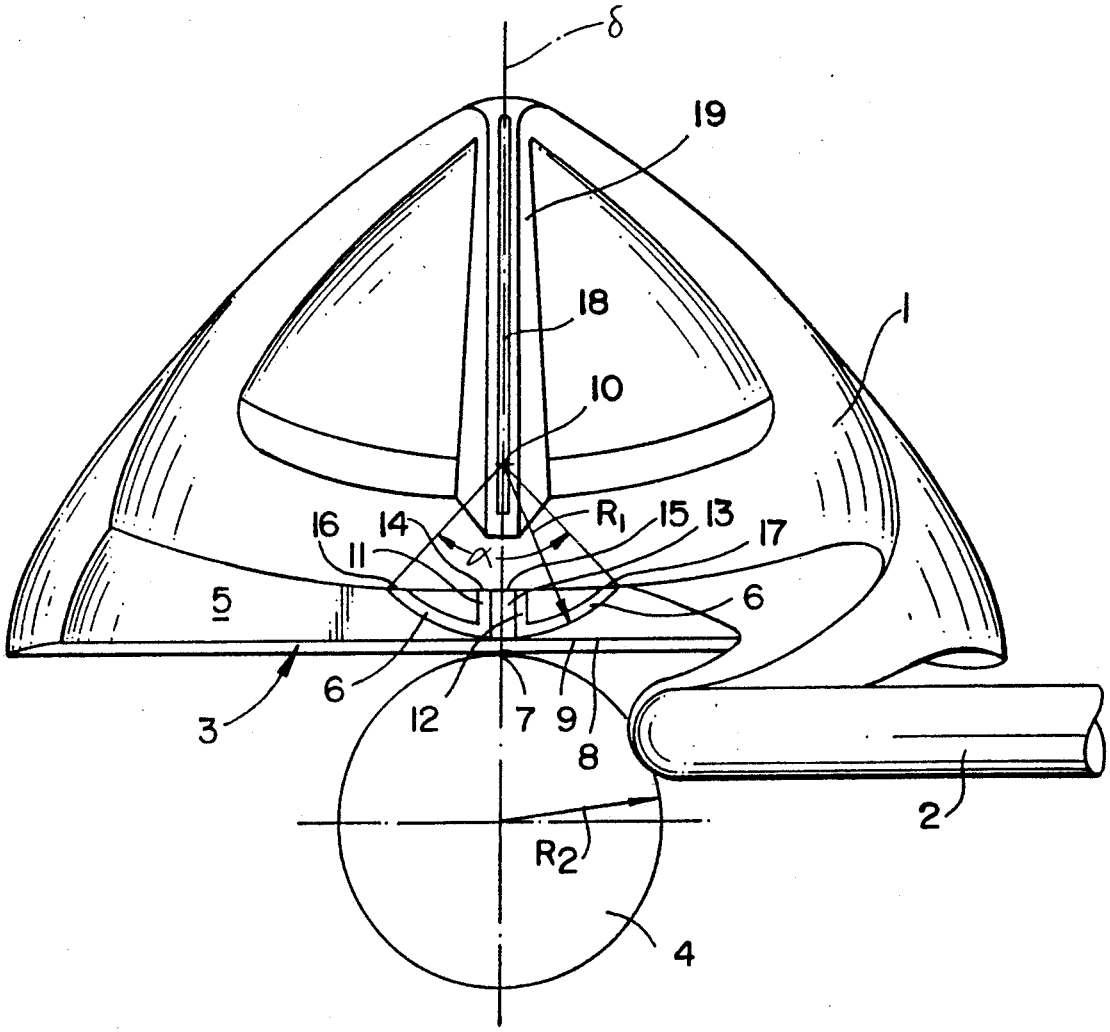
FIG. 4 is a plan view, like that of FIG. 1, illustrating a variation of the putter head according to the invention.

The upper surface 5 of body 1 carries a curvilinear line 6 which, when seen in the plan view of FIG. 1, is preferably a single arc having a radius of curvature $R_1$ with center 10. The arc 6 is tangent to straight line 8 at point 7 and parallel to edge 9 formed by the impact surface 3 with the upper surface 5. If desired, line 8 and edge 9 can be merged as shown in FIG. 4.

Center 10 of arc 6 is positioned, for purposes of symmetry, on aiming axis δ, and radius $R_1$ of the arc is the same as the nominal of radius $R_2$ of a golf ball, namely, on the order of approximately 21–35 mm.

So as not to distract the golfer's eye from the contact point 7, arc 6 extends through an angle α less than 180°. Preferably, the angle α, as illustrated, is on the order of 90°.

The centering indicia for the ball, in addition to the curvilinear line 6, includes a rectilinear line extending along the direction of the aiming axis δ from the contact point 7.

Preferably, this rectilinear line is formed by a pair of parallel segments 11 and 12 positioned on both sides of the axis δ and parallel thereto, the curvilinear line 6 not extending through the space 13 included between the two segments 11 and 12. Segments 11 and 12 extend from the region of the contact point 7 to the respective ends 14 and 15 which, again, serves to not deflect the golfer's attention from contact point 7, and which are approximately limited by the chord connecting the ends 16 and 17 of the arc 6.

Finally, another rectilinear line 18, aligned with the first, i.e., with segments 11 and 12, is provided and which serves as a parallax correction reference. To this end, as best seen in FIG. 2, reference 18 extends, in relief, upon an upstanding rearward extension 19 of the putter and at a different height from the first reference 11 and 12 such that any difference from the horizontal of the head of the putter at the moment of centering the club head with the ball will be translated visually, when viewed from above, by an offset of the reference 18 with respect the axis δ. In other words, if the golfer wants to be sure that the head of the putter is perfectly horizontal, by placing himself or herself exactly vertically with respect thereto, he or she must see reference 18 exactly aligned in the space 13 between marks 11 and 12.

Furthermore, this supplemental line 18 makes it possible to visually extend the rectilinear reference constituted by the line segments 11 and 12, which increases the precision of alignment of the aiming axis δ in the direction of the hole where the ball is to be directed.

The reference 18 is not, however, indispensable to the invention, and one could likewise form the putter head of the invention with no rearward extension 19 and reference 18, as illustrated in the embodiment shown in FIG. 3, the other elements being otherwise identical.

By way of example, the arc 6 can be formed either as a hollowed out marking or in relief, with a width of 1.5 mm and a depth, or thickness, of 0.7 mm, preferably underlined with a line of paint. With a center angle δ of 90°, the arc 6 subtends a chord of 32 mm. The marks 11 and 12 can be formed in the same manner, which gives for each mark a width of 1.5 mm over 6 mm of length. The space 13 can, for example, have a width equal to two times the thickness of marks 11 and 12 or a width of 3 mm.

Reference 18, if employed, can be formed by a hollowed out imprint, or in relief, having a width of 0.7 mm over a length of 48 mm.

Finally, although the invention has been described with reference of particular means, materials and embodiments, it is to be understood that the invention is not limited to the particulars disclosed and extends to all equivalents within the scope of the claims.

What is claimed is:

1. A putter head having a generally vertical striking surface, which is generally perpendicular to an aiming axis, and an upper surface, said striking surface and said upper surface intersecting along an edge, said upper surface further having ball-centering indicia which comprise:

a curvilinear reference comprising a line on said upper surface and which is tangent to a line parallel to said edge, at a point along said aiming axis, said curvilinear line having a radius of curvature emanating from a center of curvature and extending toward said striking surface, said radius of curvature being equal to a nominal radius of curvature of a golf ball, said curvilinear line subtending a centering angle of less than 180° with respect to a center of curvature of said curvilinear line; and a rectilinear reference extending in a direction along said aiming axis from an area proximate said tangent point.

2. The putter head of claim 1, wherein said centering angle is generally 90°.

3. The putter head of claim 1, wherein said rectilinear reference comprises, in an area adjacent said tangent point, a pair of parallel segments positioned symmetrically on either side of a line perpendicular to said line parallel to said edge.

4. The putter head of claim 3, wherein each of said segments has a width and wherein said parallel segments are spaced apart by an amount at least equal to said width.

5. The putter head of claim 3, wherein said curvilinear line is discontinuous between said parallel segments.

6. The putter head of claim 1, wherein said curvilinear line has a pair of ends, and wherein said rectilinear reference terminates opposite said tangent point approximately on a chord extending between said ends of said curvilinear line.

7. The putter head of claim 1, wherein said rectilinear reference extends along a plane, and wherein said ball-centering indicia further comprise a parallax correction reference which extends within said plane, but is not co-extensive with said rectilinear reference.

8. The putter head of claim 7, wherein said parallax correction reference extends from said rectilinear reference in a direction away from said striking surface and at a height different from a height of said rectilinear reference.

9. The putter head of claim 1, wherein said ball-centering indicia are symmetrical with respect to a plane containing said aiming axis.

10. A putter comprising the putter head of claim 1, in combination with a shaft connected to said putter head.

11. The putter head of claim 1, wherein said rectilinear reference extends along a plane, and wherein said ball-centering indicia further comprise a parallax correction reference which extends within said plane, but is not co-extensive with said rectilinear reference.

12. The putter head of claim 11, wherein said parallax correction reference extends from said rectilinear reference in a direction away from said striking surface and at a height different from a height of said rectilinear reference.

13. A putter comprising the putter head of claim 1, in combination with a shaft connected to said putter head.

14. A putter head having a generally vertical striking surface, which is generally perpendicular to an aiming axis, and an upper surface, said striking surface and said upper surface intersecting along an edge, said upper surface further having ball-centering indicia which comprise:

a curvilinear reference comprising a line on said upper surface and which is tangent to said edge, at a point along said aiming axis, said curvilinear line having a radius of curvature emanating from a center of curvature and extending toward said striking surface, said radius of curvature being equal to a nominal radius of curvature of a golf ball, said curvilinear line subtending a centering angle of less than 180° with respect to the center of curvature of said curvilinear line; and a rectilinear reference extending in a direction along said aiming axis from an area proximate said tangent point.

15. The putter head of claim 14, wherein said centering angle is generally 90°.

16. The putter head of claim 14, wherein said rectilinear reference comprises, in an are adjacent said tangent point, a pair of parallel segments positioned symmetrically on either side of a line perpendicular to said edge.

17. The putter head of claim 16, wherein each of said segments has a width and wherein said parallel segments are spaced apart by an amount at least equal to said width.

18. The putter of claim 16, wherein said curvilinear line is discontinuous between said parallel segments.

19. The putter head of claim 14, wherein said curvilinear line has a pair of ends, and wherein said rectilinear reference terminates opposite said tangent point approximately on a chord extending between said ends of said curvilinear line.

20. The putter head of claim 14, wherein said ball-centering indicia are symmetrical with respect to a plane containing said aiming axis.

* * * * *